US005661931A

United States Patent [19]

Johansson

[11] Patent Number: 5,661,931

[45] Date of Patent: Sep. 2, 1997

[54] JOIST

[75] Inventor: Lennart Johansson, Mariestad, Sweden

[73] Assignee: Nivell System Aktiebolag, Mariestad, Sweden

[21] Appl. No.: 556,972

[22] PCT Filed: Jun. 16, 1994

[86] PCT No.: PCT/SE94/00590

§ 371 Date: Dec. 8, 1995

§ 102(e) Date: Dec. 8, 1995

[87] PCT Pub. No.: WO95/01485

PCT Pub. Date: Jan. 12, 1995

[30] Foreign Application Priority Data

Jul. 1, 1993 [SE] Sweden ..... 9302270

[51] Int. Cl.[6] ..... E04G 1/22

[52] U.S. Cl. ..... 52/126.7; 52/126.1; 52/726.2

[58] Field of Search ..... 52/126.1, 126.4, 52/126.5, 126.6, 126.7, 365, 724.1, 726.2, 480, 263, 650; 248/656, 188.4

[56] References Cited

U.S. PATENT DOCUMENTS 3,127,703 4/1964 Eshelman .
3,511,001 5/1970 Morgan, Jr. ..... 52/480 X
4,360,993 11/1982 Tomokazu et al. .
5,412,917 5/1995 Shelton ..... 52/480 X
5,511,760 4/1996 Kambara ..... 248/650

FOREIGN PATENT DOCUMENTS

WO85/04441 10/1985 WIPO .

*Primary Examiner*—Creighton Smith
*Attorney, Agent, or Firm*—Nixon & Vanderhye P.C.

[57] ABSTRACT

A joist for building constructions includes an oblong body with threaded holes for receiving cylindrical, threaded space and level adjusters that are screwed into the holes to protrude from the joist body and thereby form an air gap with respect to the supporting surface and to adjust the level of the joist body. The threads of the holes are formed directly in the joist body and the space and level adjusters, threaded from end to end, have a length such that a rear portion situated inside the joist body and a front portion have part-lengths that enable a secure thread connection. The space and level adjusters are arranged in the central plane and/or in two rows on each side of the central plane.

20 Claims, 2 Drawing Sheets

JOIST

CROSS REFERENCE TO RELATED APPLICATION

This application is the U.S. National Phase of International Application No. PCT/SE94/00590, filed Jun. 16, 1994.

BACKGROUND AND SUMMARY OF THE INVENTION

The present invention relates to a joist for building constructions, comprising an elongated, form-stable body with a flat outer side and an inner side. The body is provided with a plurality of circular through-holes spaced from each other and extending perpendicularly to and between the outer and inner sides. The walls of the holes are provided with threads with predetermined pitch, and a plurality of load-bearing space and level adjusters of straight, circular cylindrical shape. Each space and level adjuster has an external thread of the same pitch as the thread of the hole wall and is provided with engagement structure accessible from the outside of the joist body for co-operation with a turning device. The space and level adjusters have a diameter of 10–40 mm, preferably 15–25 mm, and are screwed into the holes with their front portions protruding from the joist body to form an air gap between the supporting surface and the joist body and to adjust the outer side of the joist body at a desired level. The remaining portion of the space and level adjuster is in firm thread engagement with the joist body, and the rear end is located below or in plane with the outer side of the joist body.

When building a floor construction, for instance, solid floor joists are used that usually consist of timber and due to their sealing effect, the air circulation under the finished floor is poor, or even non-existent. This often contributes to problems of damp and mold occurring. Furthermore, the floor joist is generally in direct contact with the supporting surface, and if this is damp, the floor joist may absorb this dampness and the moisture-absorbing parts gradually rot. Expensive clearance work and reconstruction are then required when the resultant unavoidable damage is to be repaired. The level of the floor is also determined by the dimension of the floor joists, and the range of floor joists can therefore be relatively large if all requirements for different floor levels are to be satisfied. Unevenness of the supporting surface is another difficulty with regard to installing the joists at the correct level.

The object of the present invention is to greatly reduce the problems mentioned above and provide a joist that will enable air to circulate as well as being easy to install at the desired level, and which can be easily and quickly produced even directly on site where the joists are to be used.

The joist according to the present invention is substantially characterized in that the threads in the holes are effected directly in the joist body, that said threads on the space and level adjusters extend from end to end, that the space and level adjusters have a length such that a rear portion situated inside the joist body in order to maintain the requisite thread engagement, has a part-length of at least 10 mm, preferably at least 20 mm, whereas the front portion has a part-length of at least 1 mm, preferably at least 5 mm, in order to form the air gap, and that the space and level adjusters are arranged in the central plane of the joist body, bisecting the outer and inner sides at right angles and/or in two rows and alternating on each side of the central plane of the joist body.

BRIEF DESCRIPTION OF THE DRAWINGS

The invention will be described further in the following with reference to the drawings.

DETAILED DESCRIPTION OF THE DRAWINGS

Figure 1:
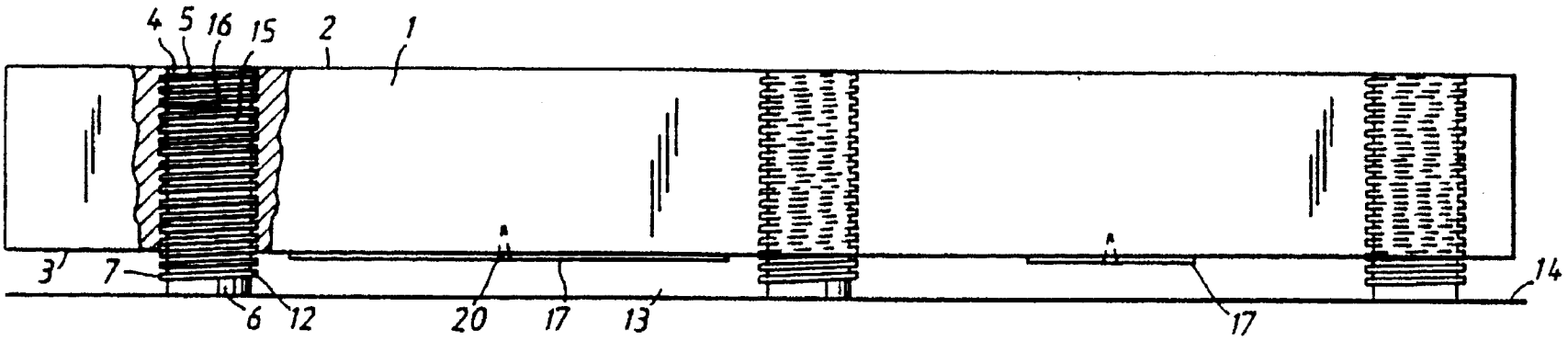
FIG. 1 is a side view of a joist according to the present invention.
Figure 2:
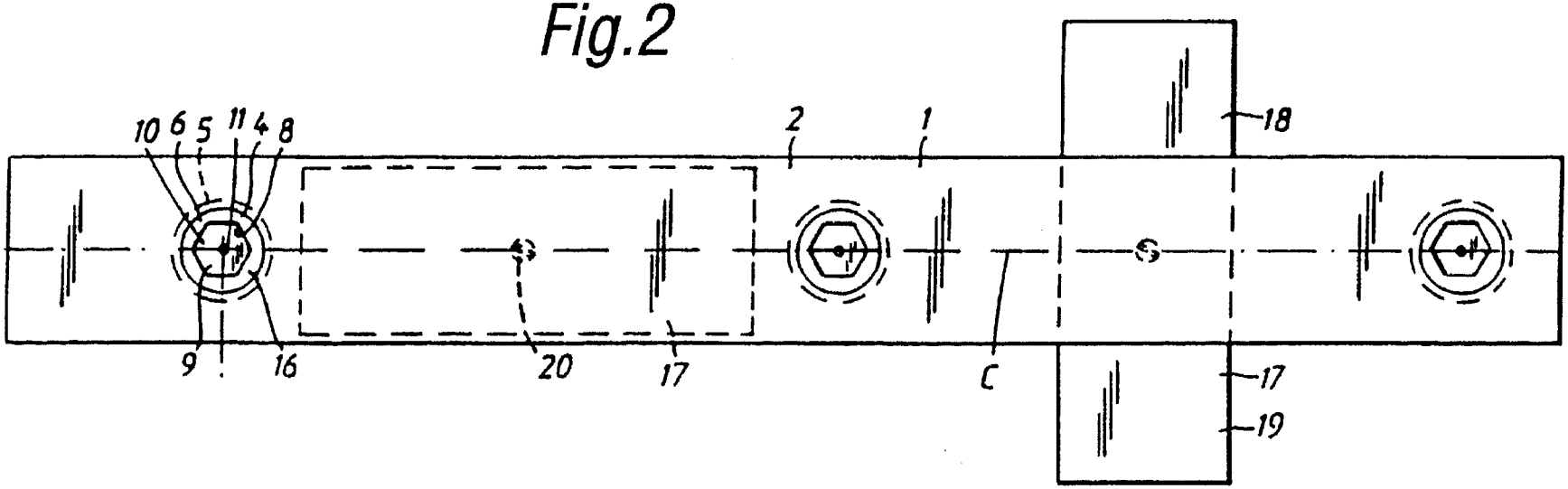
FIG. 2 is a side view of the joist according to FIG. 1.
Figure 3:
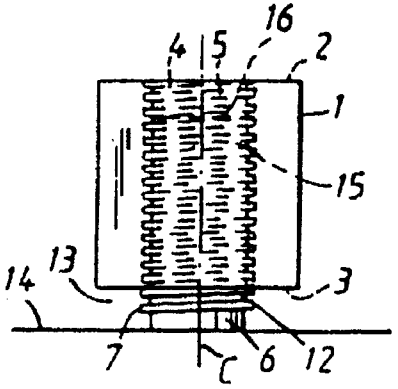
FIG. 3 is an end view of the joist according to FIG. 1.

The joist shown in the drawings comprises a body 1 which is generally straight and elongated in shape. The joist body 1 has rectangular cross section with a flat outer side 2 and a flat inner side 3 parallel with the outer side 2. C denotes a vertical central plane through the joist body.

The joist body is provided with a plurality of circular, vertical through-holes 4 arranged at predetermined distance from each other and extending perpendicularly to and between the outer and inner sides 2, 3. The distance between two adjacent holes 4 is suitably between 5 and 200 cm, a preferred distance being between 30 and 60 cm. The distance chosen in each case between two adjacent holes is suitably constant along the whole length of the joist body 1. The walls of the holes 4 have threads with predetermined pitch and the threads 5 are effected in advantageous manner directly in the joist body 1, thus eliminating the necessity for special inserts and so that drilled and threaded holes 4 can be produced simply and quickly, preferably at the same instant. The entire hole 4 is threaded, i.e. from the outer side 2 to the inner side 3 of the joist body.

Furthermore, the joist comprises a plurality of load-bearing space and level adjusters 6, similar to the shaft of a bolt, having straight, circular, cylindrical form. Each space and level adjuster 6 has an external thread 7 with the same pitch as the thread 5 of the wall of the hole, and is also provided with engagement means 8 freely accessible from the outside 2 of the joist body for co-operation with a turning device (not shown). The entire length of the space and level adjuster 6 is threaded externally, i.e. the thread 7 extends from the front end to the rear end of the adjuster. In the embodiment shown the space and level adjuster 6 is provided with a hexagon socket 9 to receive a corresponding turning device in the form of a hexagon wrench, the hexagon socket 9 being preferably of limited depth, i.e. not through-running, to provide a bottom part 10 which is in turn provided with a narrower through-hole 11 intended for a nail or screw to be driven into the supporting surface 14 to secure the space and level adjuster 6 to the supporting surface 14, but preferably without preventing turning of the space and level adjuster 6 in case further level adjustment should be required. In an alternative embodiment the engagement means consists of a transverse groove in the rear end of the space and level adjuster, for co-operation with a screwdriver. A combination of groove and hexagon socket is also possible.

The space and level adjusters 6 are thus screwed into the holes 4 in the joist body, their front portions 12 protruding out of the joist body 1 to form an air gap 13 between the supporting surface 14 and the joist body and also to adjust the outer side 2 of the joist body to a desired level. The remainder of the space and level adjuster 6, i.e. the rear portion 15 situated inside the joist body 1 is in firm thread engagement with the joist body, the rear end 16 of the space and level adjuster then being located below or flush with the outer side 2 of the joist body.

The diameter of the space and level adjuster 6 is chosen to ensure that it is sufficiently strong to be able to carry the loads that will rest on and affect the joists, without the space and level adjuster 6 being bent and so that the thread engagement area is sufficiently large to ensure strong thread engagement even when the rear end 16 of the space and level adjuster 6 is located below the outer side 2 of the joist body. A suitable diameter is 10–40 mm, preferably 15–25 mm. Furthermore, the length of the space and level adjuster 6 is chosen such that a strong thread engagement is obtained even when the rear end 16 of the space and level adjuster 6 is located at a distance from and below the outer side 2 of the joist body, i.e. the portion 15 situated inside the joist body is sufficiently long in combination with the selected diameter, and also that a desired maximal level adjustment can be achieved. A suitable length is 0–3 cm longer than the distance between the outer side 2 and the inner side 3, measured after final mounting. The length may be greater at the start of mounting and part of the space and level adjuster 6 will also protrude from the outer side 2 of the joist body when the level adjustment has been completed. The protruding piece is then sawn off and the surface section ground down to be flush with the outer side 2 of the joist body. When the space and level adjuster 6 is utilized for maximal level adjustment in each individual case, the length of the rear portion 15 of the space and level adjuster 6 located in the joist body is at least 10 mm, preferably at least 20 mm, depending on the load to be placed on the joist body 1 and space and level adjusters 6 by the rest of the building construction and external heavy objects. The front portion 12 has a part-length of at least 1 mm, preferably at least 5 mm to provide the air gap desired in each particular case.

In the embodiment shown the space and level adjusters 6 are arranged in the middle of the joist body, i.e. in the central plane of the joist body. In an alternative embodiment they may be arranged in two rows on each side of the central plane if the width of the joist body permits. This allows the joist to be placed standing on a floor surface, with the outer side 2 in horizontal position.

The joist also comprises support members 17 for insulation material. In the embodiment shown these support members consist of rectangular, deformable metal plates having a width less than or equal to the width of the joist body 1 and a length greater than the width of the joist body, in order to form free end portions 18, 19 situated at the sides of the joist body to support sheets of insulation. The end portions 18, 19 are suitably 3–6 cm in length. Each plate 17 is mounted on the inner side 3 of the joist body by means of a central screw 20 to retain the plate 17 while permitting it to be turned 90° from an inner resting position to an outer, operative position to support the insulation. According to another preferred embodiment of the support members, each consists of an angle profile having a U-shaped part with two parallel side pieces, and also two wings protruding laterally away from each other at right angles in order to support insulating material between two joists, the U-shaped part being designed to straddle the joist from above, the connecting piece that joins the two parallel side pieces together, being in contact with the upper side of the joist. The angle profile is preferably made of a stable sheet-metal blank that has been bent at right angles along four score lines.

Some of the plates 17 may be used temporarily as support for the joist to keep it in upright position in the same way as the space and level adjusters 6 located at the side of the central plane C. For this purpose the plates 17 are turned to the operative position and their end portions 18, 19 are bent down to form legs that temporarily support the joist on a floor surface. Once level adjustment has been performed the end portions are bent up to position in order to support sheets of insulating material placed between the joists. If a joist is to be placed close to and along a wall or the like, the end portions 18, 19 of the plates 17 are bent up against the side of the joist body 1.

The joist according to the invention is easy to manufacture and easy to install on all types of surfaces for floors, walls and ceilings. The actual joist body 1 may be made of any suitable material such as wood, plastic or metal, e.g. steel, that provides a form-stable joist body with sufficient bearing capacity. The joist body may be solid or hollow. In the latter case, it must be ensured that the holes 4 have sufficient wall surface for threading. The space and level adjusters 6 are suitably manufactured from a hard plastic material, giving them the required bearing capacity and also being resistant to aging.

When the joist body consists of wood or plastic, the joists can be supplied in different dimensions or even in continuous lengths for cutting with ordinary tools, and joined in suitable manner. The space and level adjusters may even be mounted in the joists on site, in which case the joist body may be predrilled or drilling may be performed on site.

I claim:

1. A joist for building constructions, comprising:

an elongated, form-stable joist body with a substantially flat outer side and an inner side, and a central plane, said body being provided with a plurality of circular through-extending holes spaced from each other and extending substantially perpendicularly to and between said outer and inner sides, a circumferential inner surface of the holes being provided with internal threads of a predetermined pitch; and a plurality of load-bearing space and level adjusters of substantially straight, cylindrical shape, each space and level adjuster having an external thread of substantially the same pitch as the internal threads of the holes and having a portion accessible from outside of the joist body for co-operation with a turning device, said space and level adjusters being screwed into said holes with front portions of the space and level adjusters protruding from the joist body to form an air gap between a supporting surface and the joist body and to adjust the outer side of the joist body at a desired level, a remaining portion of the space and level adjusters being in firm threaded engagement with the joist body so that a rear end of the space and level adjusters is located below or in plane with the outer side of the joist body, wherein said internal threads are formed directly in the joist body and said external threads on the space and level adjusters extend from end to end, said space and level adjusters having a length such that said remaining portion situated inside the joist body in order to maintain requisite thread engagement has a part-length of at least 10 mm, and said front portion has a part-length of at least 1 mm, in order to form said air gap.

2. A joist as claimed in claim 1, wherein said space and level adjusters have a diameter of 10 to 40 mm.

3. A joist as claimed in claim 1, wherein said space and level adjusters are disposed in said central plane bisecting the outer and inner sides at substantially right angles.

4. A joist as claimed in claim 1, wherein said remaining portion situated inside the joist body in order to maintain the requisite thread engagement has a part-length of at least 20 mm.

5. A joist as claimed in claim 1, wherein said front portion has a part-length of at least 5 mm to form said air gap.

6. A joist as claimed in claim 1, wherein the distance between two adjacent holes is between 5 and 200 cm.

7. A joist as claimed in claim 6, wherein the distance between two adjacent holes is between 30 and 60 cm, and wherein each of said space and level adjusters has a diameter of 15 to 25 mm.

8. A joist as claimed in claim 1, further comprising a plurality of support members adapted to support insulation between two parallel joists.

9. A joist as claimed in claim 8, wherein each support member comprises a plate pivotably mounted on said inner side of the joist body, thereby enabling it to be turned about 90° from a resting position to an operative position with free end portions of each supporting member protruding on both sides of the joist body.

10. A joist as claimed in claim 9, wherein the plates are deformable.

11. A joist as claimed in claim 1, wherein said portion accessible from outside of said joist body comprises a hexagon socket for co-operation with a corresponding hexagon wrench.

12. A joist as claimed in claim 11, wherein the hexagon socket comprises a hole therethrough adapted to receive a connecting device to anchor the space and level adjuster, at least in axial direction, to the supporting surface.

13. A joist as claimed in claim 8, wherein each support member comprises an angle profile having a U-shaped part with two parallel side pieces, and two wings protruding laterally away from each other at substantially right angles in order to support insulating material between two joists, the U-shaped part being designed to straddle the joist from above, wherein a connecting piece that joins the two parallel side pieces together is disposed in contact with the upper side of the joist.

14. A joist for building constructions, comprising:

an elongated body including a plurality of threaded through-holes spaced from each other and extending through said body; and a plurality of load-bearing space and level adjusters having an external thread corresponding to the threaded holes in said elongated body, said space and level adjusters having a length such that a rear portion situated inside the elongated body in order to maintain requisite thread engagement has a part-length of at least 10 mm and a front portion has a part-length of at least 1 mm to form an air gap between said elongated body and a supporting surface.

15. A joist as claimed in claim 14, further comprising a plurality of support members adapted to support insulation between two parallel joists.

16. A joist as claimed in claim 15, wherein each support member comprises a plate pivotably mounted on a side of the joist body facing the supporting surface, said support members being turnable about 90° from a resting position to an operative position with free end portions of each supporting member protruding on both sides of the joist body.

17. A joist as claimed in claim 16, wherein the plates are deformable.

18. A joist as claimed in claim 14, wherein each of said space and level adjusters comprises an engagement member accessible from outside of the elongated body.

19. A joist as claimed in claim 18, wherein the engagement members comprise a hole therethrough adapted to receive a connecting device to anchor the space and level adjusters, at least in axial direction, to the supporting surface.

20. A method for anchoring a joist for building constructions to a supporting surface, the joist including an elongated body having a plurality of threaded through-holes spaced from each other and extending through the body, and a plurality of load-bearing space and level adjusters having an external thread corresponding to the threaded holes in the elongated body, the method comprising the steps of:

threading the space and level adjusters into corresponding holes in the elongated body so that the adjusters have a threaded engagement portion cooperating with the holes of at least 10 mm, and a front portion extending outwardly from the elongated body of at least 1 mm;

securing the space and level adjusters to the supporting surface; and leveling the elongated body relative to the supporting surface by rotating respective ones of the space and level adjusters.

* * * * *